US007217008B2

(12) United States Patent
Thompson et al.

(10) Patent No.: US 7,217,008 B2
(45) Date of Patent: May 15, 2007

(54) LUMINAIRE AND METHOD FOR CHANGING A LUMINOUS MEANS

(76) Inventors: Choy Wing Chee Thompson, House 7, Ever Green Villa, Ngau Ken Tsuen, Kam Sheung Road, Pat Heung, NT, Kowloon (HK); Choy Tze Fung Jackson, House 7, Ever Green Villa, Ngau Ken Tsuen, Kam Sheung Road, Pat Heung, NT, Kowloon (HK)

( * ) Notice: Subject to any disclaimer, the term of this patent is extended or adjusted under 35 U.S.C. 154(b) by 161 days.

(21) Appl. No.: 11/003,435

(22) Filed: Dec. 6, 2004

(65) Prior Publication Data

US 2006/0087850 A1 Apr. 27, 2006

(30) Foreign Application Priority Data

Oct. 22, 2004 (DE) ..... 10 2004 051 449

(51) Int. Cl.
*F21S 1/02* (2006.01)
*F21V 19/02* (2006.01)

(52) U.S. Cl. ..... 362/285; 362/365; 362/372; 362/647; 362/652; 362/371; 362/370

(58) Field of Classification Search ..... 362/363, 362/364, 365, 368, 370, 371, 372, 285, 287, 362/418, 427, 647, 652, 655
See application file for complete search history.

(56) References Cited

U.S. PATENT DOCUMENTS 3,694,649 A * 9/1972 Thompson ..... 362/390
4,722,032 A * 1/1988 Kulka ..... 362/549
5,289,358 A * 2/1994 Halemeier ..... 362/365
5,548,499 A * 8/1996 Zadeh ..... 362/366
5,581,448 A * 12/1996 Harwood ..... 362/147
6,149,280 A * 11/2000 Quiogue et al. ..... 362/147
6,505,960 B2 * 1/2003 Schubert et al. ..... 362/365

FOREIGN PATENT DOCUMENTS

| | | |
|---|---|---|
| CH | 6 87 564 A5 | 12/1996 |
| DE | 91 09 267 U1 | 10/1991 |
| DE | 198 08 912 A1 | 9/1999 |
| DE | 100 29 405 A1 | 1/2002 |

* cited by examiner

*Primary Examiner*—Thomas M. Sember
(74) *Attorney, Agent, or Firm*—Hoffman, Wasson & Gitler, PC

(57) ABSTRACT

Proposed is a luminaire, with a housing and a luminous means receptacle for fitting a luminous means in the housing, in which the luminous means receptacle is connected to the housing via a bearing means which is suitable for altering the position of the luminous means receptacle with respect to the housing, with the result that the luminous means can be replaced in a convenient manner. An advantageous method for changing a luminous means is also provided.

17 Claims, 4 Drawing Sheets

LUMINAIRE AND METHOD FOR CHANGING A LUMINOUS MEANS

BACKGROUND OF THE INVENTION

The present invention relates to a luminaire and a method for changing a luminous means.

Luminaires are sufficiently well known. Such luminaires are made up of a housing and a luminous means receptacle arranged within the housing. The luminous means receptacle is principally provided to produce a mechanical connection between the luminous means and the housing.

In particular in the case of luminaires which are envisaged for installation in flat panels, for example of a room ceiling, the luminaire is introduced into a suitable hole in the ceiling. Correspondingly, a large part of the luminaire is accommodated in a region on the other side of the hole which is no longer accessible, whereas only the part of the luminaire which is relevant for light emergence protrudes from the ceiling. This gives an aesthetically sophisticated unit made from the luminaire and the room ceiling.

The compact construction, in particular the fact that the luminous means is accommodated within the housing, brings about the disadvantage that neither the luminous means nor the luminous means receptacle are accessible for maintenance purposes, and that the luminous means can only be replaced with considerable effort, for example by removing or dismantling the housing. However, this problem does not only occur in the case of the recessed ceiling luminaires mentioned above but also in the case of all luminaires whose housing surrounds the luminous means such that it is not possible to replace the luminous means without dismantling the surrounding housing.

Difficulty in accessing the luminaire and the housing is where the present invention comes into play. The invention addresses, as an object, the provision of a luminaire in which the luminous means can be replaced in a simple manner.

SUMMARY OF THE INVENTION

This object is achieved by a luminaire as embodied by the invention. Owing to the fact that the luminous means receptacle is connected to the housing via a bearing means, which makes it possible to alter the position of the luminous means receptacle with respect to the housing, there are now possibilities for moving the luminous means receptacle or the accommodated luminous means at least from an operating position inside the housing to a maintenance position outside or at least partially outside of the housing. In the maintenance position, access may now be gained to the luminous means, and it can be replaced accordingly. Then, the luminous means receptacle may be moved back with the replaced luminous means to the operating position.

Provision may also advantageously be made for the housing to have an opening, a luminous means accommodated by the luminous means receptacle finishing approximately flush with the opening in an operating position, while a luminous means accommodated by the luminous means receptacle protrudes at least partially from the opening in a maintenance position. Owing to the configuration proposed here, aesthetically sophisticated luminaires can be provided, since the luminous means can finish flush with the housing. On the other hand, it is easily possible for the luminous means to be replaced by the luminous means being removed from the opening.

As one advantageous refinement of the present invention, provision may be made for the housing to have a cylindrical installation frame and a U-shaped bracket, the opening extending axially along the installation frame, the bracket protruding over the opening, and the luminous means receptacle being arranged at least partially between the U-shaped bracket. Such a refinement of the luminaire uses very little material and is advantageously suitable for installation in a flat panel, preferably in a room ceiling. The limbs of the U-shaped bracket may also advantageously be used for accommodating the luminous means receptacle such that it can be displaced.

Provision may also advantageously be made for the bearing means to be in the form of a linear bearing which can be displaced on the bracket. A linear bearing is particularly advantageously suitable for altering the position, as required, of the luminous means receptacle, or the accommodated luminous means, even in a small physical area, as may be available, for example, in the case of surface-mounted luminaires. Also conceivable are, of course, further bearing types, for example even pivot bearings, by means of which it is possible to alter the position of the luminous means receptacle or the accommodated luminous means.

In one further advantageous refinement of the present invention, provision may be made for the luminous means receptacle to have a mount which at least partially spans the region between the limbs of the U-shaped bracket. Consequently, the luminous means receptacle may be positioned at a suitable point on the housing.

Provision may also advantageously be made for the luminous means receptacle to be equipped with a socket for accommodating the luminous means. A corresponding socket may be matched to the luminous means which is to be used in each case and can be replaced in a simple manner.

Provision may also advantageously be made for the socket to be suitable for accommodating the luminous means by rotation, half-rotation or by plugging. Consequently, rapid and convenient connection of the luminous means to the luminous means receptacle is possible.

Provision may also preferably be made for the luminous means to be an incandescent lamp having the socket specification GU10, GZ10, MR11, MR16 or a light-emitting diode having the socket specification GU10 or G5.3 or a fluorescent lamp having the socket specification GU10, E14 or E27 or a PAR lamp (parabolic aluminized reflector lamp whose reflector is fixedly connected and which emits directed light) having the socket specification R50, R63 or R80, in each case a corresponding socket being provided.

In a further advantageous refinement of the present invention, provision may be made for the luminous means receptacle to be equipped with a latching apparatus which is suitable for locking the luminous means receptacle or the luminous means either in an operating position or a maintenance position. Consequently, it is possible to achieve convenient handling of the luminaire when the luminous means is replaced, since the corresponding positions are approached discretely and are maintained as long as is necessary, for example, for replacing the luminous means.

Provision may also advantageously be made for the latching apparatus to be designed such that both the force for moving the luminous means receptacle from the operating position to the maintenance position and the force for moving the luminous means receptacle from the maintenance position to the operating position are identically aligned. A latching apparatus designed in this manner is similar in terms of its operation to a press-action ballpoint pen, whose point can be moved in and out by pressing the actuating means. Consequently, by pressing the luminous means in the operating position it is possible to release the locking action of the latching means and to move the luminous means receptacle or the luminous means to a maintenance position, it being possible to move the luminous means receptacle or the luminous means back to the operating position by again pressing the luminous means in a maintenance position. Consequently, convenient operation of the luminaire according to the invention can be ensured and there is no need, for example, to provide further operating elements, since the luminous means receptacle according to the invention can be operated solely using the luminous means itself.

In one advantageous refinement of the invention, provision may be made for the latching apparatus to have a guide in the luminous means receptacle, in which a guide cam is guided, the guide cam being provided at one end of a spring element connected to the housing. Such a refinement of the latching apparatus is advantageously suitable for meeting the requirements for the latching apparatus. A latching apparatus designed in this manner may also provide a spring prestress which assists in or carries out the displacement between the operating position and the maintenance position.

For the case in which the socket/luminous means combination is a plug connection, it is advantageously possible to provide between the luminous means receptacle and the housing a locking apparatus which is suitable for locking the luminous means receptacle or the luminous means in the maintenance position. Accordingly, a pluggable luminous means can be replaced without being unintentionally pushed back to the operating position.

Provision may advantageously be made for the locking apparatus to be in the form of a spring rod having a projection, it being possible for the projection to engage in a housing-side latch in a maintenance position, and it being possible for the connection between the projection and the latch to be released by an actuating element provided at one end of the spring rod. Such a design can be realized simply and, above all, cost-effectively.

Another object of the previous invention is to have an advantageous method for changing a luminous means in a luminaire.

It is clear that the method can be also adapted for first install of a luminous means in a luminaire according to the present invention.

BRIEF DESCRIPTION OF THE DRAWINGS

Further features and advantages of the present invention become apparent with the description below of preferred exemplary embodiments with reference to the attached figures, in which.

DETAILED DESCRIPTION OF THE INVENTION

Figure 1:
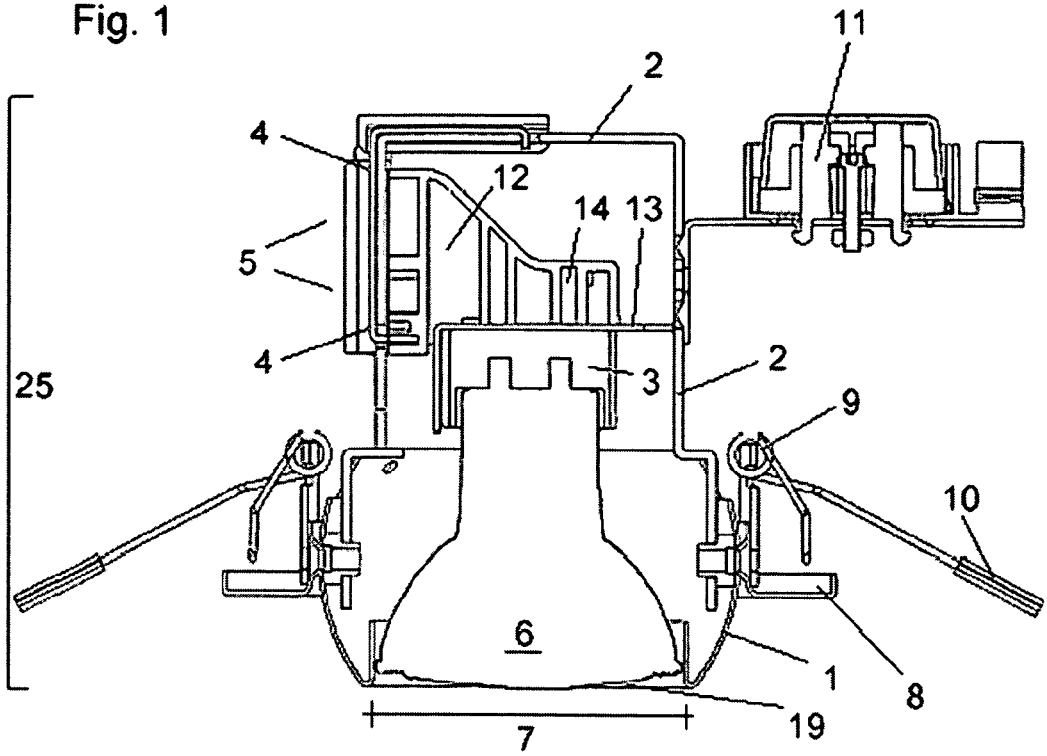
FIG. 1 shows a cross-sectional illustration of a luminaire according to the invention in an operating position.

A luminaire according to the invention for a luminous means 6 is made up of a housing 25 with a cylindrical installation frame 1, which is slightly in the form of a spherical segment, having a centrally provided opening 7, the opening 7 extending axially along the housing 25. The housing 25 also has a U-shaped bracket 2 which spans the opening 7 in a projecting manner. The luminaire according to the invention also has a luminous means receptacle 5 which is fitted to the bracket 2 and is suitable for accommodating and positioning the luminous means 6 in the opening 7. Consequently, a light-exit surface 19 of the luminous means 6 may finish approximately flush with the opening 7.

In order to install the luminaire in a flat panel (not shown), for example a room ceiling, the installation frame 1 is provided with an installation apron 8 which, in an installed state, rests on the panel. For the purpose of fixing the luminaire in the flat panel, a spring mechanism 9 is provided which is equipped with a horizontal arm 10. For mounting purposes, the luminaire is at least partially pushed into a prepared hole, the spring mechanism 9 being activated once it has been pushed into the hole, and the horizontal arm 10 resting on the ceiling inner face. Correspondingly, the horizontal arm 10 is braced against the installation apron 8 and the luminaire is fixed.

The luminous means receptacle 5 is at least partially in the form of a mount 12 which at least partially bridges the region between the limbs of the U-shaped bracket 2. The luminous means receptacle 5 also has a socket 3 which is fitted to the mount 12 via an adapter element 13. As the socket 3, in principle all available luminous means sockets which are suitable for connecting a luminous means are possible. Conceivable are, for example, combinations comprising a socket and a luminous means of the type series GU10, GZ10, MR11, MR16, and the luminous means may also be in the form of a light-emitting diode having the pairing GU10, G5.3. Likewise conceivable are fluorescent lamps having a GU10, E14 or E27 connection. It is also possible for PAR lamps of the type R50, R63 or R80 to be used. The socket 3 is essentially suitable for providing both a releasable electrical and mechanical connection with the luminous means 6. Of course, the luminous means receptacle 5 may be matched to all other socket/luminous means combinations. The mount 12 is also provided with holes 14 for passing through electrical lines. A connection terminal 11 is also provided for supplying the electrical connections.

Further details of the present luminaire according to the invention are advantageously given in a description of the basic mode of operation.

An operating position of the luminous means 6 in relation to the housing 25 can be seen in FIG. 1. The light-exit surface 19 of the luminous means 6 finishes approximately flush with the opening 7 in this operating position and essentially fills the opening 7. It is understandable that it is not possible to handle the luminous means 6, in particular to replace the luminous means 6, since access cannot be gained to the luminous means 6 at any point.

Provision is now made for the luminous means receptacle 5 to also have a bearing means 4 which is suitable for moving the luminous means 6 either between an operating position and a maintenance position or between a maintenance position and an operating position.

Figure 2:
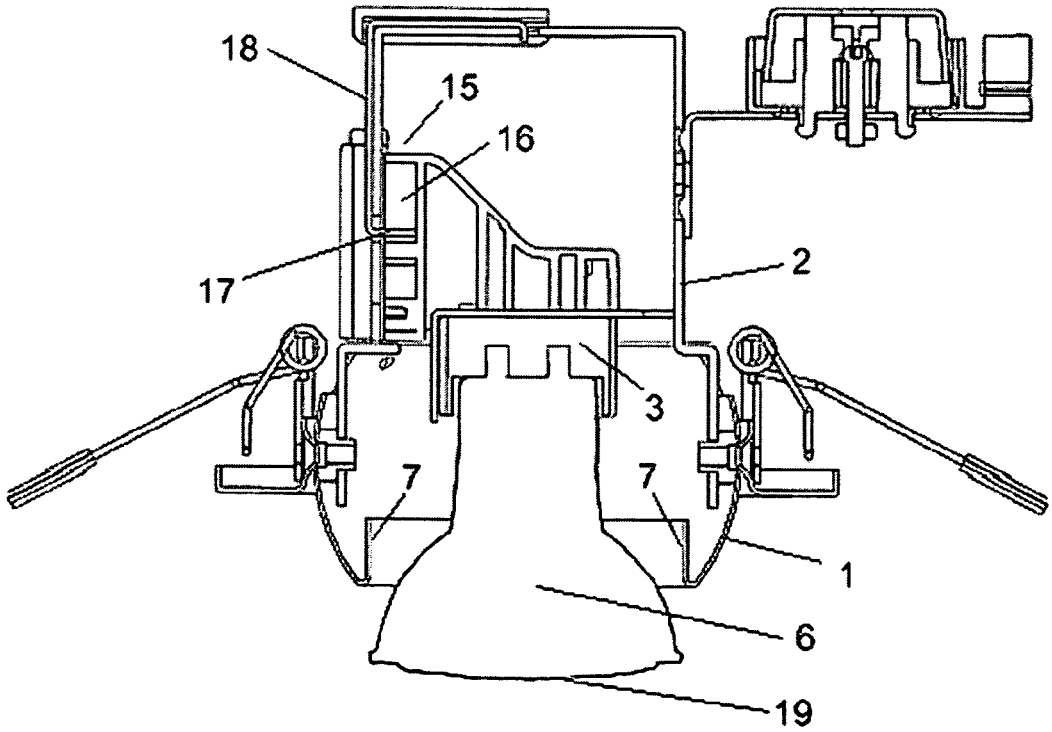
FIG. 2 shows a cross-sectional illustration of a luminaire according to the invention in a maintenance position.

The maintenance position is illustrated in FIG. 2. In this maintenance position, the luminous means 6 is in a maintenance position, i.e. the luminous means 6 protrudes at least partially from the opening 7, but at least to such an extent that it can be accessed by a user. It is thus possible to ensure simple replacement of the luminous means 6, since access can now be gained to the luminous means 6 without any problems, and it can be rotated or plugged depending on the selection of the mounted socket.

The bearing means 4 is essentially in the form of a linear bearing which allows displacement of the luminous means receptacle 5 along a limb of the U-shaped bracket 2. Of course, other bearing forms are also conceivable which can make it possible, in principle, to alter the position of the luminous means receptacle 5 in the required manner. The design of the bearing means 4 as a linear bearing advantageously makes it possible to move the luminous means 6 in a correspondingly suitable manner inside or outside of the opening 7, but at least between the above-described operating and maintenance positions.

Provision is made for the bearing means 4 to be equipped with a latching apparatus 15. The latching apparatus 15 is suitable for fixing the luminous means receptacle 5 or the luminous means 6 either in the operating position or the maintenance position. For this purpose, the latching apparatus 15 has a guide 16, in which a guide cam 17 can engage. The guide cam 17 is in turn fitted at one end of a spring element 18, which is fixed on the bracket 2. The mode of operation of the latching apparatus 15 is similar to the actuation of a press-action ballpoint pen. Starting from the operating position in FIG. 1, the luminous means 6 can be pushed slightly into the opening 7 by lightly pressing on the light-exit surface 19 or the luminous means 6. By this means, the latching apparatus 15 is initially released, and the luminous means 6 moves out of the opening 7 once the pressure drops off. In this case, the bearing means 4 glides along the limb of the bracket 2, as a result of which, of course, the mount 12, the socket 3, and thus the luminous means 6 are likewise moved in the direction of the opening 7 until a maintenance position is reached. For this maintenance position, too, there is a corresponding position for the guide cam 17 and the guide 16, with the result that the latching apparatus 15 remains in the predeterminable maintenance position. In accordance with the above-described procedure for moving the luminous means 6 from the operating position to the maintenance position, the luminous means 6 can be moved back to an operating position in the same manner by a force again being exerted on the light-exit surface 19 or the luminous means 6, and by the luminous means 6 being pushed in the direction of the operating position. If the operating position is reached, the latching apparatus 15 is latched in again. The latching apparatus 15 is advantageously subjected to a spring prestress which assists the movement from the operating position to the maintenance position. Consequently, the spring prestress provides a low opposing force when the luminous means receptacle 5 is moved from the maintenance position back to the operating position.

Figure 3:
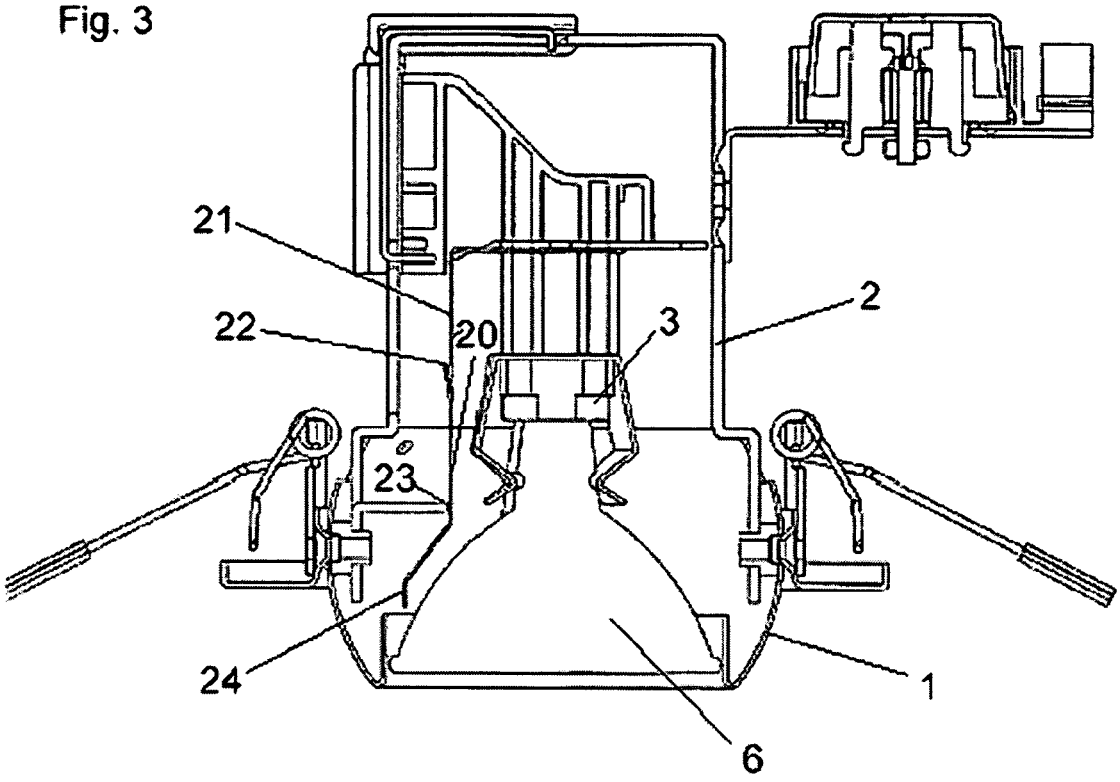
FIG. 3 shows a cross-sectional illustration of a further developed embodiment of a luminaire according to the invention in an operating position.
Figure 4:
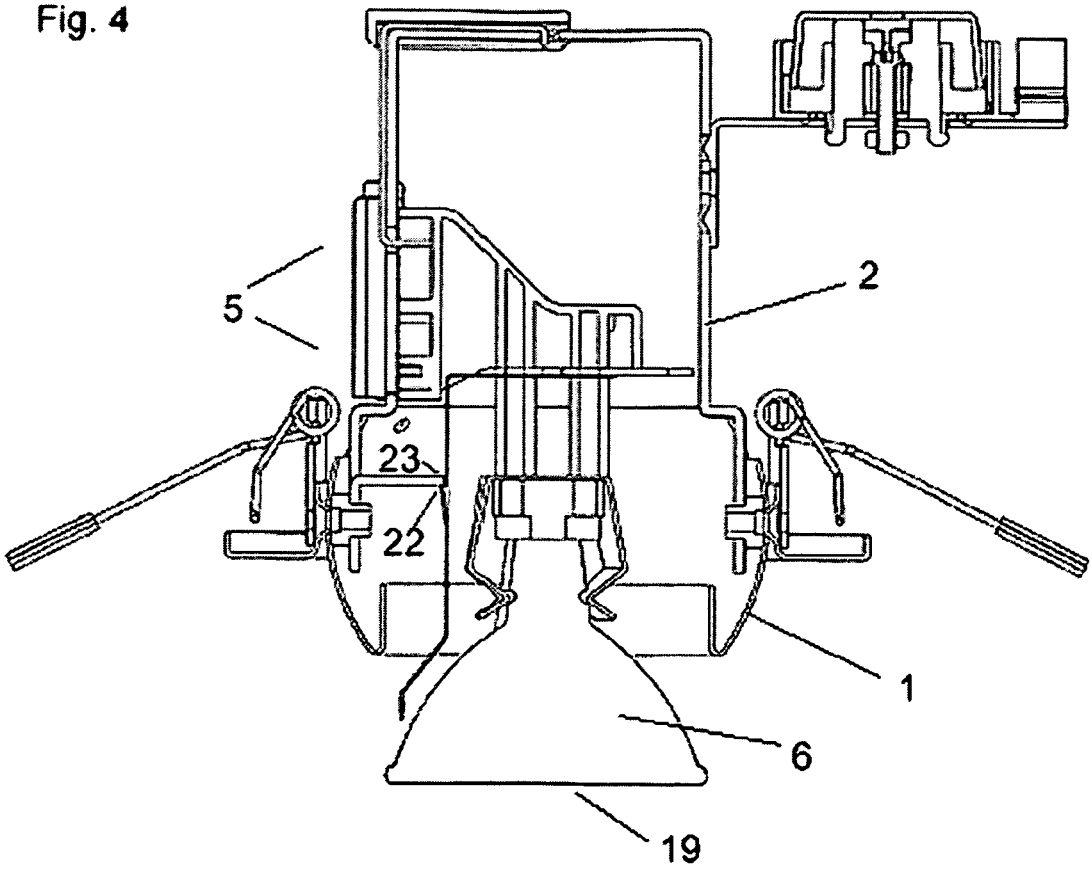
FIG. 4 shows a cross-sectional illustration of a further developed embodiment of a luminaire according to the invention in a maintenance position.
Figure 5:
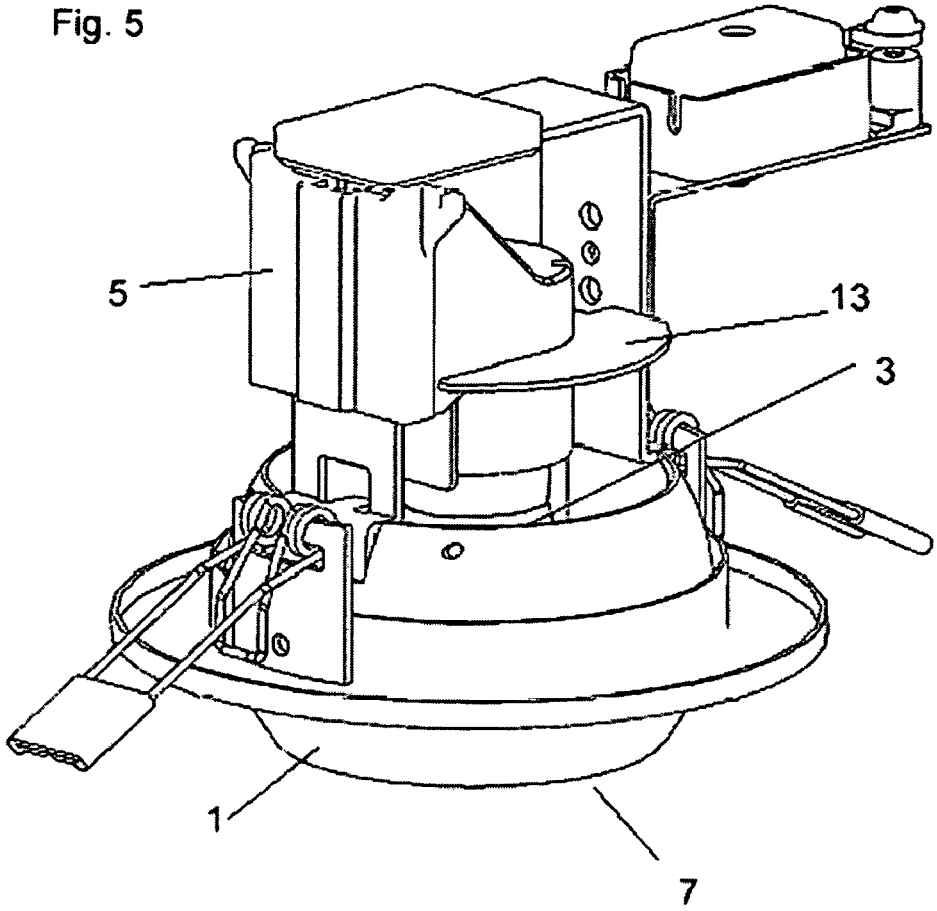
FIGS. 5–8 show further perspective illustrations of a luminaire according to the invention.
Figure 6:
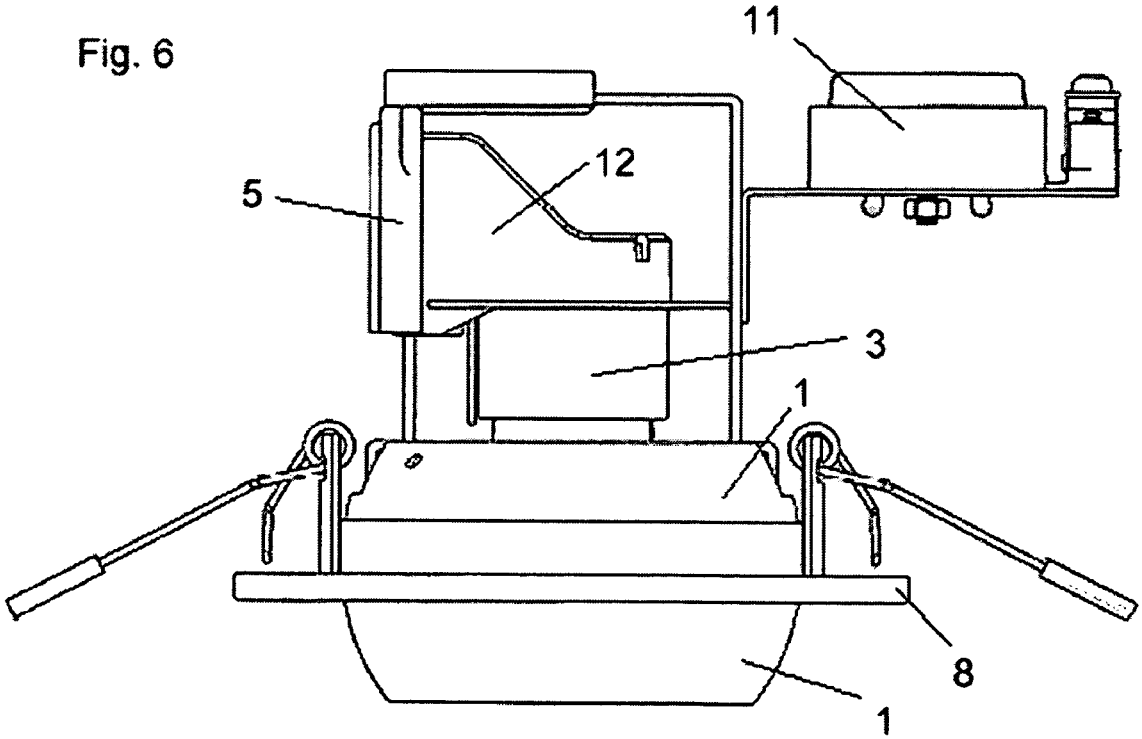
Figure 7:
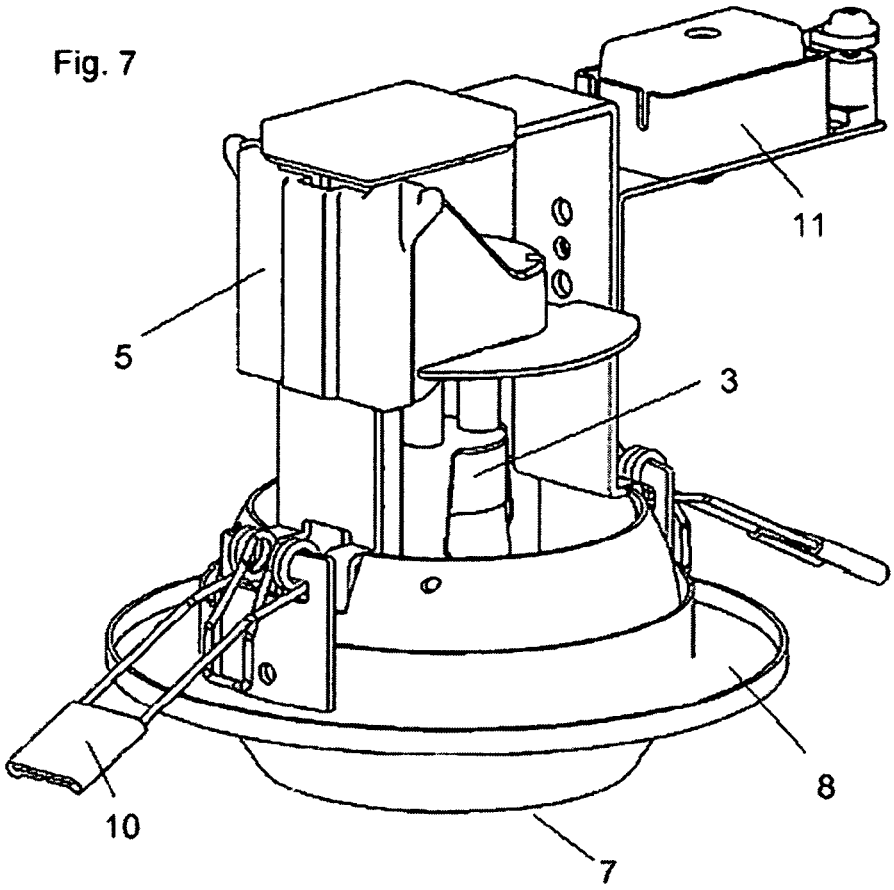
Figure 8:
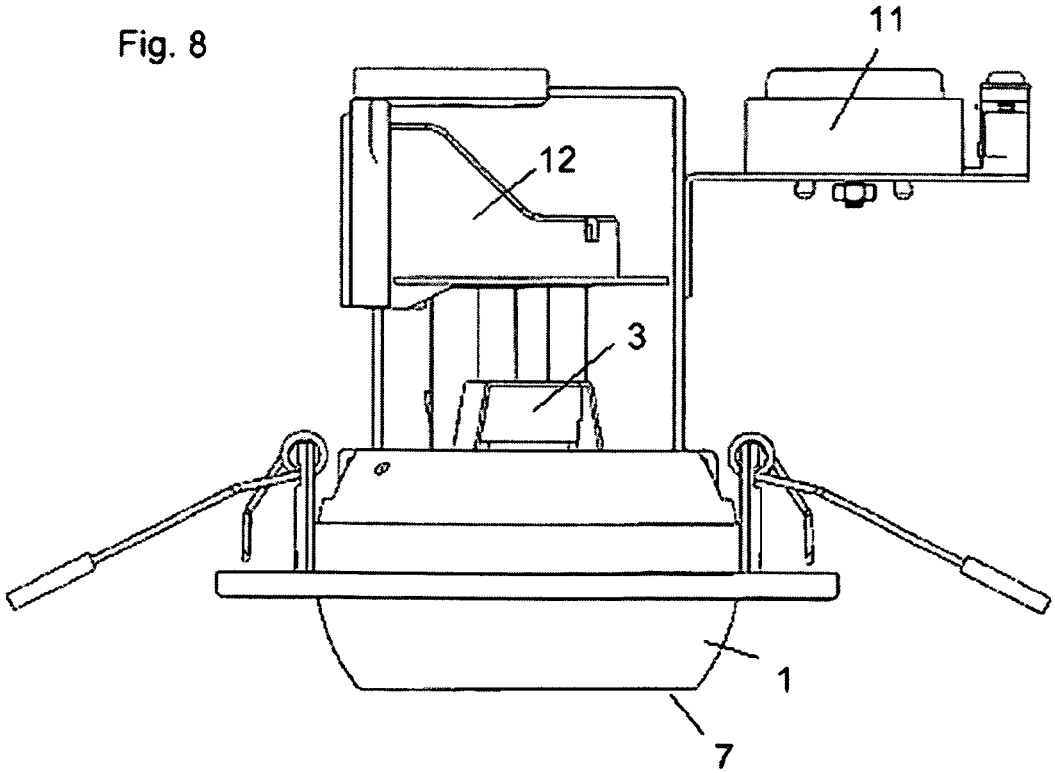

A further preferred embodiment of the present invention is illustrated in FIGS. 3 and 4.

In principle, three different socket/luminous means systems are known which differ by the means of actuation—half-rotation, rotation and plugging. Whilst the above-described preferred embodiment of the luminaire according to the invention is preferably suitable for socket/luminous means systems which can be locked or released by rotation or half-rotation, for socket/luminous means systems which are connected by plugging there is the problem that plugging in a luminous means 6 in the maintenance position can likewise lead to a movement of the luminous means receptacle 5 or the luminous means 6 in the direction of the operating position.

A locking apparatus 20 is provided in order to counteract this movement, which is undesired in this case. The locking apparatus 20 is in principle suitable for fixing the luminous means receptacle 5 in the maintenance position. In the embodiment illustrated here, the locking apparatus 20 is made from a spring rod 21 having a projection 22 and an actuating element 24. The spring rod 21 is fixed on the luminous means receptacle 5 and extends in the direction of the luminous means 6 and the opening 7. The projection 22 is fitted on a suitable section of the spring rod 21, with the result that a latch 23 can be engaged behind in the region of the housing 25 in a maintenance position. Consequently, the luminous means receptacle 5 can be locked in the maintenance position, and the luminous means 6 replaced. In order to release the locking apparatus 20, the easily accessible actuating element 24 is actuated, as a result of which the spring rod 21 is bent and the connection between the latch 23 and the projection 22 is released. Consequently, the luminous means 6 or the luminous means receptacle 5 can be moved to the operating position as has already been described above.

What is claimed is:

1. A luminaire, comprising a housing, and a luminous means receptacle for fitting a luminous means in the housing, wherein the luminous means receptacle is connected to the housing via a bearing means which makes it possible to alter the position of the luminous means receptacle with respect to the housing the housing has an opening, the luminous means accommodated by the luminous means receptacle finishing approximately flush with the opening in an operating position, while the luminous means accommodated by the luminous means receptacle protrudes at least partially from the opening in a maintenance position wherein the housing comprises a cylindrical installation frame and a U-shaped bracket, the opening extending axially alone the installation frame, the bracket protruding over the opening, and the luminous means receptacle being arranged at least partially between the U-shaped bracket.

2. The luminaire according to claim 1, wherein the bearing means is in the form of a linear bearing which can be displaced on the bracket.

3. The luminaire according to claim 1 wherein the luminous means receptacle comprises a mount which at least partially spans the region between the limbs of the U-shaped bracket.

4. The luminaire according to claim 1, wherein the luminous means receptacle is equipped with a socket for accommodating the luminous means.

5. The luminaire according to claim 4, wherein the socket is suitable for accommodating the luminous means by rotation, half-rotation or by plugging.

6. The luminaire according to claim 1, wherein the luminous means is an incandescent lamp having a socket specification GU10, GZ10, MR11, MR16 or a light-emitting diode having the socket specification GU10 or G5.3 or a fluorescent lamp having the socket specification GU10, E14 or E27 or a PAR lamp having the socket specification R50, R63 or R80, in each case a corresponding socket being provided.

7. The luminaire according to claim 1, wherein the luminous means receptacle is equipped with a latching apparatus which can be actuated by an action of a force on the luminous means and is at least suitable for locking the luminous means receptacle or the luminous means either in an operating position or a maintenance position.

8. The luminaire according to claim 7, wherein the latching apparatus is such that both the force for moving the luminous means receptacle from the operating position to the maintenance position and the force for moving the luminous means receptacle from the maintenance position to the operating position are identically aligned.

9. The luminaire according to claim 7, wherein the latching apparatus comprises a guide in the luminous means receptacle, in which a guide cam is guided, the guide cam being provided at one end of a spring element connected to the housing.

10. The luminaire according to claim 1, wherein a locking apparatus is provided between the luminous means receptacle and the housing which is suitable for locking the luminous means receptacle or the luminous means in the maintenance position.

11. The luminaire according to claim 10, wherein the locking apparatus is in the form of a spring rod having a projection, the projection to engages in a housing-side latch in a maintenance position, and the connection between the projection and the latch is released by an actuating element provided at one end of the spring rod.

12. A method for changing a luminous means in a luminaire, comprising the steps of:

placing the luminous means and the luminous receptacle means are in an operating position;

displacing the luminous means and the luminous receptacle means from the operating position to a maintenance position,where the luminous means is reachable by a user;

the luminous means can be changed in the maintenance position; and the luminous means and the luminous receptacle means are displaced from the maintenance position in the operating position wherein the luminous means and luminous means receptacle are displaced from the operating position in the maintenance position by single push on the luminous means, whereby the luminous means and the luminous receptacle means are displaced from the maintenance position in the operating position by single push on the luminous means.

13. The method according to claim 12, comprising a luminaire in accordance with claim 1.

14. The method according to claim 12 wherein the single push is performed on the light-exit surface of the luminous means.

15. A luminaire, comprising a housing, and a luminous means receptacle for fitting a luminous means in the housing, wherein the luminous means receptacle is connected to the housing via a bearing means which makes it possible to alter the position of the luminous means receptacle with respect to the housing, whereby the luminous means receptacle is equipped with a latching apparatus which can be actuated by the action of a force on the luminous means and is at least suitable for locking the luminous means receptacle or the luminous means either in an operating position or a maintenance position, whereby the latching apparatus is such that both the force for moving the luminous means receptacle from the operating position to the maintenance position and the force for moving the luminous means receptacle from the maintenance position to the operating position are identically aligned.

16. The luminaire of claim 15, wherein both the force for moving the luminous means receptacle from the operating position to the maintenance position and the force for moving the luminous means receptacle from the maintenance position to the operating position are pushing forces.

17. The luminaire of claim 15, wherein the latching apparatus comprises a bracket, a guide, a guide cain engaged to the guide, and a spring extending between the guide cam and bracket.

* * * * *